United States Patent [19]

Ono et al.

[11] Patent Number: 4,640,299

[45] Date of Patent: Feb. 3, 1987

[54] DRYING AND CONDITIONING APPARATUS FOR TOBACCO

[75] Inventors: Takahiro Ono, Hiratsuka; Takao Akutsu, Tokyo; Hideyuki Fujiwara, Hadano, all of Japan

[73] Assignee: Japan Tobacco Inc., Tokyo, Japan

[21] Appl. No.: 685,043

[22] Filed: Dec. 21, 1984

[30] Foreign Application Priority Data

Dec. 23, 1983 [JP] Japan ..... 58-242088

[51] Int. Cl.[4] ..... A24B 3/04

[52] U.S. Cl. ..... 131/303; 131/304; 131/306

[58] Field of Search ..... 131/302–306, 131/300; 34/45, 46

[56] References Cited

U.S. PATENT DOCUMENTS

| | | | |
|---|---|---|---|
| 2,528,982 | 11/1950 | Touton | 131/303 |
| 3,948,277 | 4/1976 | Wochnowski et al. | 131/303 |
| 4,004,594 | 1/1977 | Wochnowski et al. | 131/303 |
| 4,178,946 | 12/1979 | Knight | 131/303 |
| 4,192,323 | 3/1980 | Horne | 131/303 |
| 4,452,256 | 6/1984 | Wochnowski et al. | 131/303 |
| 4,513,759 | 4/1985 | Wochnowski et al. | 131/303 |

FOREIGN PATENT DOCUMENTS 1452925 10/1976 United Kingdom .

*Primary Examiner*—V. Millin
*Assistant Examiner*—H. Macey
*Attorney, Agent, or Firm*—Shlesinger Arkwright Garvey & Fado

[57] ABSTRACT

An apparatus for drying and conditioning tobacco leaves, including a heater for heating conditioning air for conditioning tobacco leaves after drying, a temperature controller for controlling the heater so that the temperature of the conditioning air becomes a preset temperature, an atomized water sprayer for cooling the conditioning air fed to the heater, a humidifier for humidifying the conditioning air, and a humidity controller for detecting the moisture content of the tobacco leaves after drying and conditioning and controlling the humidifier so that the moisture content of the tobacco leaves becomes a target moisture content. The humidity controller is so constructed as to control the humidifier on the basis of a wet-bulb temperature. Saving of heat energy can be attained, and because a cooling chamber is not needed, the apparatus can be made compact and it becomes easier to stabilize a target moisture content.

4 Claims, 6 Drawing Figures

DRYING AND CONDITIONING APPARATUS FOR TOBACCO

BACKGROUND OF THE INVENTION

The present invention relates to a drying and conditioning apparatus for tobacco and more particularly to an apparatus capable of adjusting the temperature and humidity of conditioning air.

In threshing leaf tobacco, excess moisture is given to the leaf tobacco so that threshing can be done to a satisfactory extent. The tobacco leaf (lamina) after threshing and separation from the vein is stored for ageing. In this case, since excess moisture was given to the tobacco leaf at the time of threshing as mentioned above, it is necessary to dry and condition the tobacco leaf before aging.

As an apparatus for performing such drying and conditioning operations, there has heretofore been known an apparatus having a drying chamber, a cooling chamber and a conditioning chamber, in which first tobacco leaves are dried in the drying chamber to a moisture content (7–10% DB) lower than a target moisture content (12–14% DB), then cooled in the cooling chamber and thereafter conditioned to the target moisture content in the conditioning chamber.

The reason why the tobacco leaves are dried to a lower moisture content than the target value and then cooled is that the air humidity in the conditioning chamber cannot be adjusted and it is around 100% RH.

In case the average moisture content of tobacco leaves after drying is set high, conditioning of the leaves with 100% RH air would cause some of the leaves to have higher moisture contents than a target value since the intermediate layer portion of each tobacco leaf is higher in moisture content than the other portion and there is a dispersion as a whole, and the growth of mold would result during aging. Such dispersion is decreased by lowering the average moisture content after drying, and since cooling causes lowering of the leaf temperature, the moisture content can be increased to a larger extent at the time of conditioning.

However, drying tobacco leaf to a moisture content lower than a target value, then cooling it and thereafter conditioning to the target moisture content, is a waste of heat energy.

If the temperature and moisture of conditioning air can be adjusted, the above problem will be overcome. As an apparatus for adjusting the temperature and humidity of air in the tobacco manufacturing field, for example, an apparatus having a steam atomizer and a cooler is known (see Japanese Patent Publication No. 13260/1982).

According to such known apparatus, however, it is impossible to adjust the temperature and humidity of conditioning air of about 40°–70° C. required for conditioning of tobacco leaves although it is possible to adjust the temperature and humidity of circulating air of about 20° C.

For example, in the case of adjusting air of 20° C., 50% RH to 60° C., 60% RH, if steam is sprayed up to an absolute humidity corresponding to 60° C., 60% RH, its amount becomes 0.0759 kg/kg'.

Absolute humidity of 20° C., 50% RH . . . 0.0073 kg/kg'
Absolute humidity of 60° C., 60% RH . . . 0.0832 kg/kg'

$$0.0832-0.0073=0.0759 \text{ kg/kg'}$$

However, the enthalpy at 20° C., 50% RH is 9.2 kcal/kg', and the enthalpy of steam to be sprayed is 49.0 kcal/kg' in the case of using saturated steam. On the other hand, the enthalpy at 60° C., 60% RH is 66.3 kcal/kg'. That is, a heat quantity of $66.3-(9.2+49.0)=8.1$ kcal/kg' is deficient. This quantity of heat is beyond the range capable of being made up for by the heat of adsorption of steam to the raw material or the heat generated by operation of a fan.

Therefore, it is impossible to reduce the heat energy by applying the above known construction to tobacco drying and conditioning apparatus.

SUMMARY OF THE INVENTION

The present invention has been accomplished in view of the above-mentioned circumstances, and it is the object thereof to provide a drying and conditioning apparatus for tobacco capable of adjusting the temperature and humidity of conditioning air used for conditioning treatment to thereby reduce the heat energy consumed in the entire apparatus.

To achieve the above object, the tobacco leaf drying and conditioning apparatus of the present invention is characterized by including a heater for heating conditioning air for conditioning tobacco leaves after drying, a temperature controller for controlling the heater so that the temperature of the conditioning air becomes a preset temperature, an atomized water sprayer, for cooling the conditioning air fed to the heater, a humidifier for humidifying the conditioning air, and a humidity controller for detecting the moisture content of the tobacco leaves after drying and conditioning and controlling the humidifier so that the moisture content of the tobacco leaves becomes a target moisture content.

According to the present invention, therefore, tobacco leaves can be dried to a moisture content near the target value and then conditioned to the target moisture content in a conditioning chamber, thereby permitting energy saving.

BRIEF DESCRIPTION OF THE DRAWINGS

The accompanying drawings illustrate an embodiment of the present invention, in which.

DETAILED DESCRIPTION OF THE EMBODIMENTS

An embodiment of the present invention will be described hereinunder with reference to the accompanying drawings.

Figure 1:
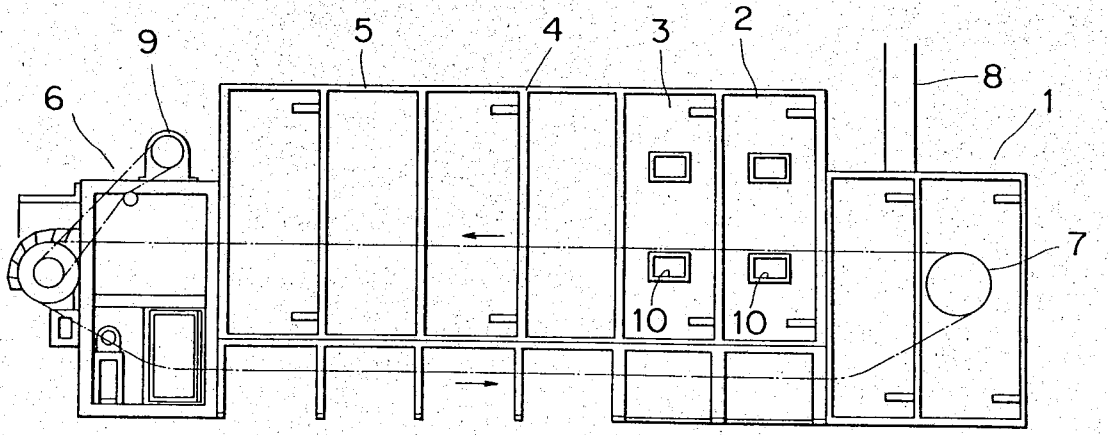
FIG. 1 is a side view of the entirety of a drying and conditioning apparatus for tobacco according to an embodiment of the present invention.

FIG. 1 is a side view of a drying and conditioning apparatus for tobacco according to an embodiment of the present invention, in which indicated at the reference numeral 1 is an inlet portion, at 2 a first drying chamber, at 3 a second drying chamber, at 4 a first conditioning chamber, at 5 a second conditioning chamber, at 6 an outlet portion and at 7 an air-permeable conveyor.

In the inlet portion 1 is provided a hopper 8, and in the outlet portion 6 is provided a drive motor 9 for the air-permeable conveyor 7. The conveyor 7 is moved in the directions of arrows shown in FIG. 1 by means of the drive motor 9, whereby tobacco leaves introduced into the inlet portion 1 from the hopper 8 pass first through the first and second drying chambers 2 and 3, then through the first and second conditioning chambers 4 and 5 and reach the outlet portion 6.

Figure 3:
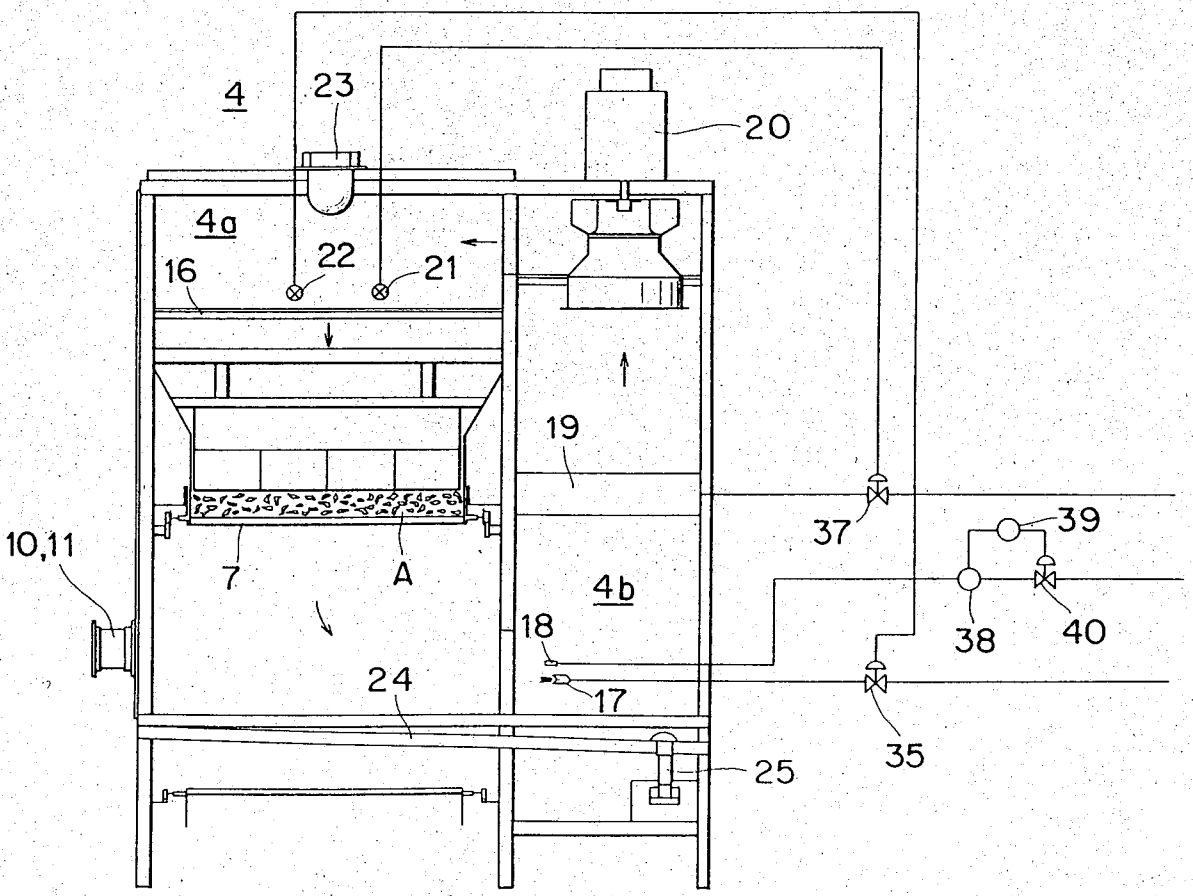
FIG. 3 is a sectional view of a first conditioning chamber.
Figure 4:
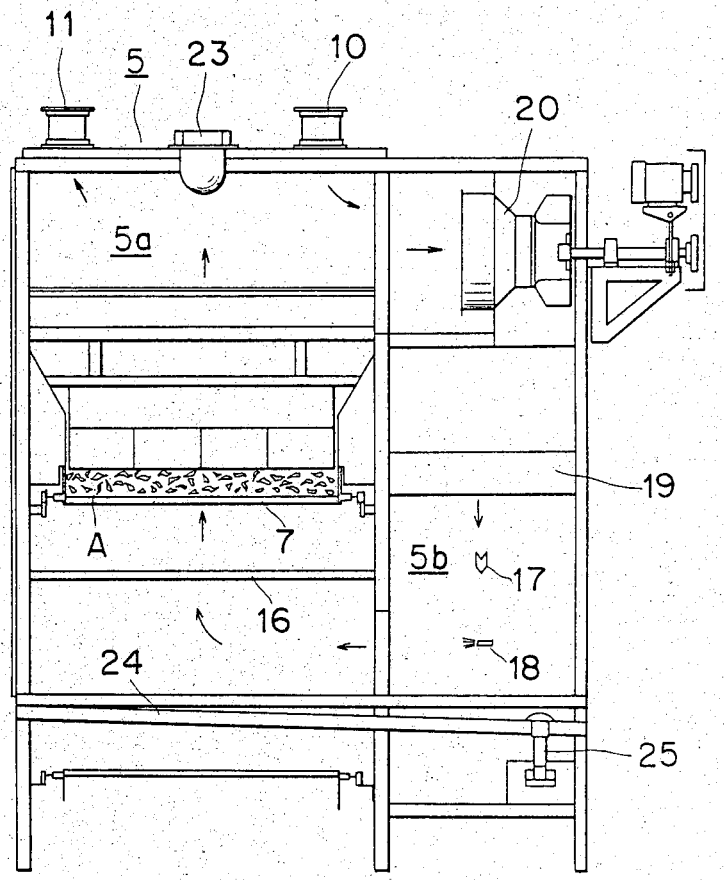
FIG. 4 is a sectional view of a second conditioning chamber.

The first and second drying chambers 2 and 3 and the first and second conditioning chambers 4 and 5 are constituted, for example, by a heat retaining plate incorporating glass wool and are each provided with an intake port 10 and an exhuast port 11 (see FIGS. 3 and 4). To each exhaust port 11 is connected an exhaust duct (not shown).

Figure 2A:
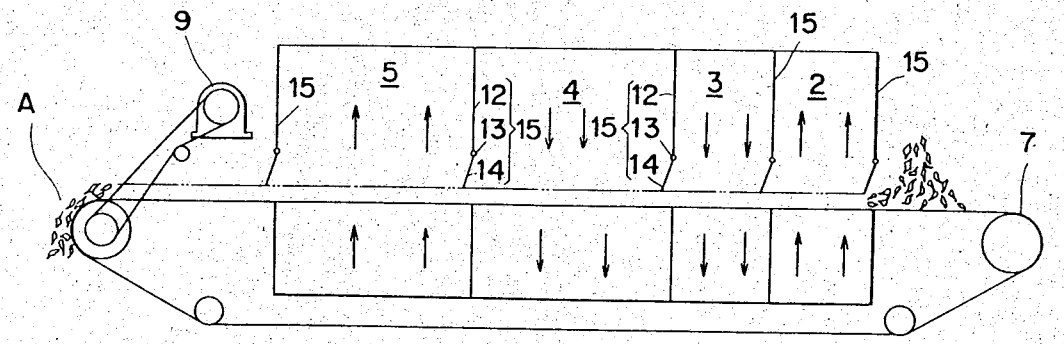
FIGS. 2*a* and 2*b* are schematic sectional views thereof.
Figure 2B:
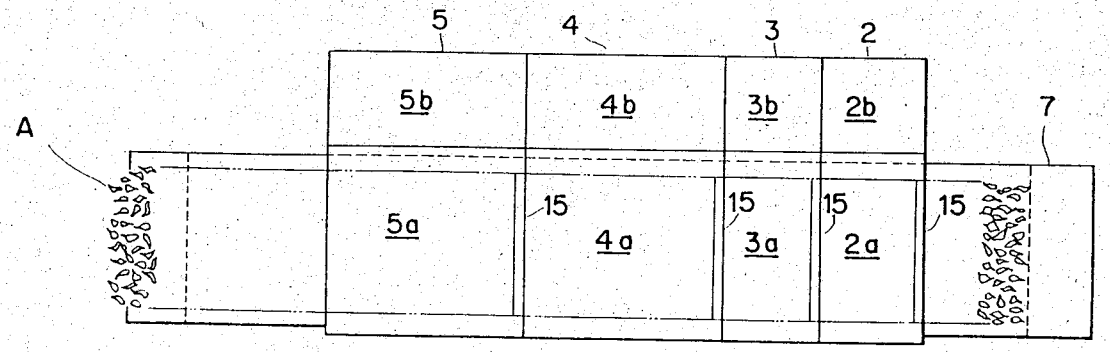

The chambers 2 to 5 are divided, as shown in FIGS. 2*a* and 2*b*, into chambers 2*a* to 5*a* in which the air-permeable conveyor 7 is disposed and chambers 2*b* to 5*b* in which is disposed a heating heat-exchanger, etc. as will be described later, respectively. The chambers 2*a* to 5*a* are partitioned by partition walls 15. The partition walls 15 are each composed of a fixed wall 12 and a rocking plate 14 attached to the lower end of the fixed wall 12 through a hinge 13. The rocking plate 14 is in sliding contact with tobacco leaves A being conveyed by the conveyor 7 to thereby prevent commingling of air in the chambers 2*a* to 5*a*. The air in the chambers 2 to 5 circulates between the chambers 2*a*–5*a* and 2*b*–5*b* while passing through the tobacco leaves A and the air-permeable conveyor 7. During circulation of air, part of the air is discharged from the exhaust port 11, while from the intake port 10 is introduced the outside air as replenishment for the discharged air.

Referring now to FIG. 3, there is illustrated in detail the first conditioning chamber 4, in which a perforated plate 16 is disposed above the air permeable conveyor 7 in the chamber 4*a*. The conditioning air is regulated its flow by the perforated plate 16, then passes through the tobacco leaves A and the conveyor 7 and thereafter enters the chamber 4*b*. In the chamber 4*b* are disposed a humidifying nozzle 17 for humidifying the conditioning air, an atomized water spraying nozzle 18 for cooling the conditioning air and a heating heat-exchanger 19 for heating the cooled conditioning air. In the ceiling of the chamber 4*b* is disposed a circulation fan 20, whereby the conditioning air which has been heated by the heating heat-exchanger 19 is directed to the ceiling side of the chamber 4*a*. On the ceiling side of the chamber 4*a* are disposed a temperature detector 21 for detecting the temperature of the conditioning air and a wet-bulb temperature detector 22 for detecting a wet-bulb temperature.

In the ceiling of the chamber 4*a* is disposed an illumination lamp 23. Further, on the bottom side of the chambers 4*a* and 4*b* are disposed a dew pan 24 and a strainer 25. The intake port 10 and the exhaust port 11 are disposed on a side wall of the chamber 4*a*.

Referring now to FIG. 4, there is illustrated in detail the second conditioning chamber 5, in which the direction of flow of the conditioning air is opposite to that in the first conditioning chamber 4, the perforated plate 16 is disposed below the conveyor 7, and the intake port 10 and the exhaust port 11 are disposed on the ceiling of the chamber 5*a*. Except these great differences, the other points in construction are about the same as in the first conditioning chamber 4.

Figure 5:
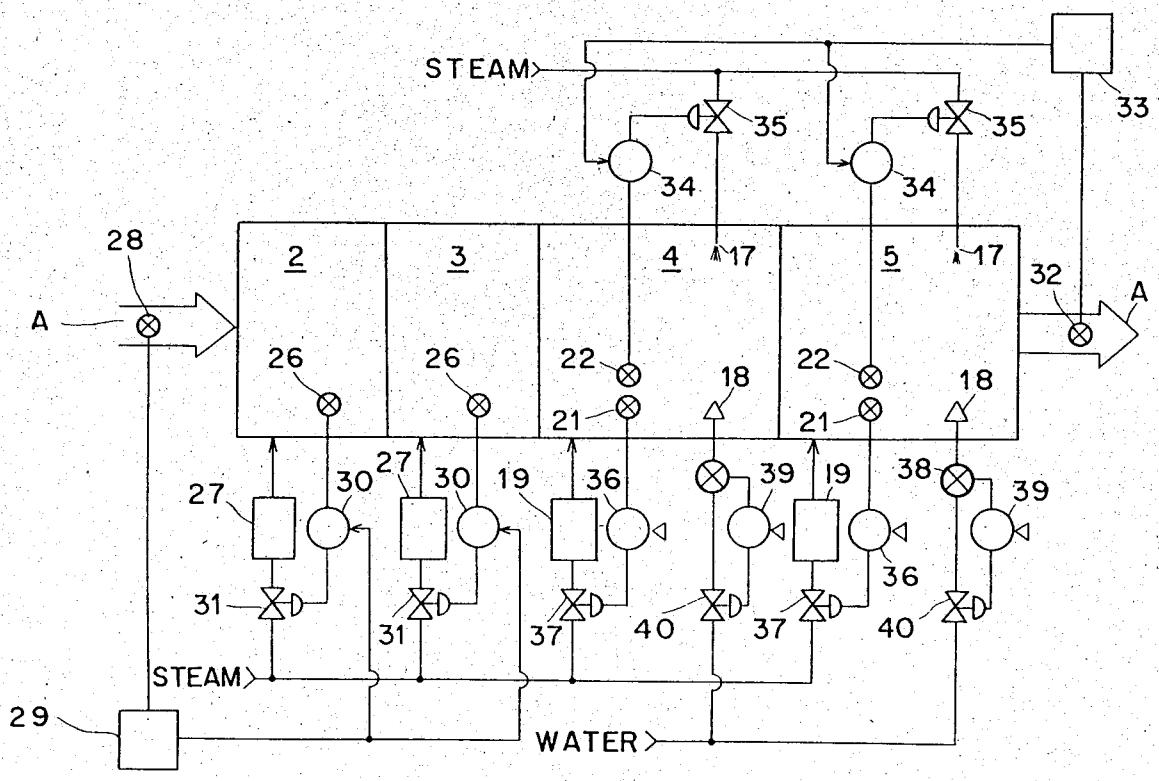
FIG. 5 is a block diagram of a control system.

Although a detailed illustration is omitted as to the first and second drying chambers 2 and 3, a temperature detector 26 for detecting the temperature of dry air is disposed in each of the chambers 2*a* and 3*a*, and a heating heat-exchanger 27 is disposed in each of the chambers 2*b* and 3*b* (see FIG. 5).

FIG. 5 is a block diagram of a control system of the tobacco drying and conditioning apparatus. The first and second drying chambers 2 and 3 are controlled by a feed-forward control system and a drying air temperature control system for each of the chambers 2 and 3.

More particularly, the moisture content of the tobacco leaves A measured by an infrared moisture meter 28. The result of this measurement is input to a computing unit 29, in which a drying air temperature according to the moisture content of tobacco leaves A is calculated. This calculation result is set as a target temperature in a temperature controller 30. The temperature controller 30 compares the measurement result provided from the temperature detector 26 with the target temperature and controls a valve 31 so that the target temperature is obtained, the valve 31 functioning to adjust the steam flow rate in the heating heat-exchanger 27.

The first and second conditioning chambers 4 and 5 are controlled by a feedback control system and a conditioning air humidity/temperature control system for each of the chambers 4 and 5.

More specifically, the moisture content of tobacco leaves A in the outlet portion 6 is measured by an infrared moisture meter 32. The result of this measurement is input to a computing unit 33, in which there is calculated an amount of change in wet-bulb temperature according to the deviation from the target moisture. This calculation result is set as a target wet-bulb temperature in a wet-bulb temperature controller 34, which in turn compares the measurement result provided from the wet-bulb temperature detector 22 with the target wet-bulb temperature and controls a valve 35 so that the target wet-bulb temperature is obtained, the valve 35 functioning to adjust the flow rate of steam ejected from the humidifying nozzle 17. The measurement result provided from the temperature detector 21 is input to a temperature controller 36, which in turn compares the measurement result with a target temperature (a fixed temperature of 40°–70° C.) and controls a valve 37 so that the target temperature is obtained, the valve 37 functioning to adjust the flow rate of steam in the heating heat-exchanger 19. Further, the flow rate of water sprayed from the atomized water spraying nozzle 18 for cooling is measured by a water flowmeter 38. The result of this measurement is input to a water flow controller 39, which in turn compares the measurement result with a target flow rate and controls a valve 40 so that the target flow rate is obtained, the valve 40 functioning to adjust the flow rate of water sprayed from the atomized water spraying nozzle 18.

As the atomized water spraying nozzle 18 there may be used, for example, "SONIMIST" (trade name, a product of Sonic Development Corporation in USA). The particle size of atomized water is in the range of about 5 to 60 microns and it is desirable that the average particle size be not larger than 20 microns. With such particle size, the conditioning air can be cooled without wetting of the tobacco leaves A, and there is no fear of the taste being spoiled.

The operation of the above embodiment will be explained below.

For example, the tobacco leaves A which have been given excess moisture in the threshing step are introduced from the hopper 8 and conveyed to the first and second drying chambers 2 and 3 by means of the air-permeable conveyor 7. The temperature of the drying air is controlled by the foregoing control system so as to dry the tobacco leaves A up to approximately the target moisture content.

At the time of transfer from the second drying chamber 3 to the first conditioning chamber 4, the tobacco leaves A are in a dried state substantially to the target moisture content. In the first and second conditioning chambers 4 and 5, the conditioning air is controlled by the foregoing control system to a temperature of 40°-70° C. and a relative humidity not lower than 60%, thereby conditioning the tobacco leaves A to the target moisture content. As a result, the tobacco leaves A are conditioned without dispersion of moisture content even in the vertical direction of the leaf layer.

In each of the conditioning chambers, the conditioning air is heated by means of the heating heat-exchanger 19. This is because a mere spraying of steam causes deficiency of heat quantity as previously noted in the case of adjusting an introduced outside air of 20° C., 50% RH to, for example, 60° C., 60% RH. And this deficiency is compensated for by the heating heat-exchanger 19.

Further, the conditioning air is cooled with atomized water sprayed from the atomized water spraying nozzle 18. More specifically, atomized water at a temperature (usually about 20° C.) lower than the temperature (40°-70° C.) of the conditioning air is used, and utilizing this difference in temperature and the latent heat of evaporation obtained at the time of evaporation of the atomized water, the conditioning air is cooled. This is because the range of heat quantity given to the conditioning air from the heating heat-exchanger 19 is set large in order to obtain a conditioning air of a wide range of 40°-70° C. and not lower than 60% RH (a value below 60% RH being also employable), whereby the temperature response characteristic of the conditioning air is improved. If this heat quantity range is narrow, for example, in the case of lowering the conditioning air temperature, it takes time until it becomes possible to impart a small heat quantity to the conditioning air since the heating heat-exchanger 19 itself also has a heat capacity, thus resulting in deterioration of the temperature response characteristic. This cooling method is less expensive than in the case of using a cooler or the like.

The humidity of the conditioning air is adjusted using steam sprayed from the humidifying nozzle 17. This is because the temperature change of steam is less than that of water. The humidity control for the conditioning air is performed on the basis of a wet-bulb temperature. More specifically, as the amount of steam sprayed is varied in order to adjust the humidity of the conditioning air, the temperature of the conditioning air changes, and if the humidity is controlled on the basis of relative humidity, the relative humidity changes due to the change in temperature even under the same absolute humidity, so that the temperature and the humidity interfere with each other, causing a large deflection of the system and making stabilization difficult. For example, in the case of adjusting the conditioning air at a temperature of 60° C. and a relative humidity of 70% to the temperature of 60° C. and relative humidity of 75%, if the flow rate of steam sprayed is so controlled as to give a relative humidity of 75%, the temperature also rises, so that the absolute humidity at the relative humidity of 75% becomes larger than the absolute humidity 0.0992 kg/kg' of the air of 60° C., 75% RH, that is, a larger amount of steam than necessary is sprayed. On the other hand, if the flow rate of steam sprayed is so controlled as to reach a wet-bulb temperature corresponding to the temperature of 60° C. and relative humidity of 75%, the absolute humidity takes a value close to 0.0992 kg/kg' although the temperature rises, and thus there will be no larger amount of steam sprayed than necessary. In other words, if control is made on the basis of wet-bulb temperature, the flow rate of steam sprayed will be scarcely interfered by the air temperature, so it is stabilized rapidly.

Thus, once the flow rate of steam sprayed is stabilized, the influence on the conditioning air temperature substantially becomes nil, so that the temperature control by the heating heat-exchanger 19 becomes stable and consequently the conditioning air temperature is also stabilized rapidly.

By drying and conditioning tobacco leaves in the manner described above, the dispersion (standard deviation) in moisture content at the outlet portion 6 can be reduced from the conventional 0.6% to 0.3% or less.

The present invention is also applicable, for example, to drying and conditioning for tobacco leaves after addition of perfume in the processing step, in addition to drying and conditioning for tobacco leaves before ageing and after threshing in the threshing step.

As set forth hereinabove, the tobacco leaves drying and conditioning apparatus of the present invention has a heater for heating conditioning air for conditioning tobacco leaves after drying, a temperature controller for controlling the heater so that the temperature of the conditioning air becomes a preset temperature, an atomized water sprayer for cooling the conditioning air fed to the heater, a humidifier for humidifying the conditioning air, and a humidity controller for detecting the moisture content of the tobacco leaves after drying and conditioning and controlling the humidifier so that the moisture content of the tobacco leaves becomes a target moisture content. With such construction, the temperature and humidity of the conditioning air can be adjusted, and therefore at the time of drying and conditioning of tobacco leaves, it is not necessary to once dry the leaves to a moisture content lower than the target moisture content and cool them, that is, saving of heat energy can be attained. Besides, the entire apparatus can be made compact because a cooling chamber is not needed. Moreover, since it is not necessary to provide a cooling chamber as just mentioned, there occurs neither a change in moisture content after cooling due to a change in temperature and humidity of cooling air (outside air) caused by a change in weather, etc. nor the resultant change in the target moisture content. Consequently, stabilization of the target moisture content becomes easier.

Further, since the conditioning air is cooled with atomized water, the temperature response characteristic is improved at the time of heating by the heater. Besides, the tobacco is not wet, so its taste does not turn bad.

Additionally, if the humidity controller is so constructed as to control the humidifier on the basis of a wet-bulb temperature, there will be no interference with the temperature control system, thus permitting a rapid stabilization of the moisture content of tobacco leaves at the outlet side of the apparatus.

What is claimed is:

1. An apparatus for drying and conditioning tobacco leaves, comprising:

a chamber for conditioning tobacco leaves therein;

means for drying the tobacco leaves prior to conditioning in said chamber;

means cooperating with said chamber for circulating conditioning air through said chamber for conditioning the tobacco leaves therein;

means in the path of the conditioning air for heating the conditioning air;

a temperature detector in the path of the conditioning air for measuring the temperature of the conditioning air;

temperature controlling means cooperating with said temperature detector and said heating means for controlling said heating means so that the temperature of the conditioning air becomes a pre-set temperature;

means in the path of the conditioning air for spraying atomized water in the conditioning air for cooling the conditioning air;

means in the path of the conditioning air for injecting steam into the conditioning air for humidifying the conditioning air;

a humidity detector in the path of the conditioning air for measuring the humidity of the conditioning air; and, means cooperating with said humidity detector and said steam injecting means for controlling said steam injecting means so that the moisture content of tobacco leaves reaches a target moisture content.

2. The apparatus for drying and conditioning tobacco leaves according to claim 1, wherein said humidity detector comprises means for measuring the wet-bulb temperature of the circulating air.

3. The apparatus for drying and conditioning tobacco leaves according to claim 1, and including a second chamber adjacent said first conditioning chamber for conditioning the tobacco leaves, said second conditioning chamber having means for circulating conditioning air through said second chamber for conditioning the tobacco leaves therein, said second chamber circulating means being adapted to circulate the conditioning air with respect to the tobacco leaves therein in a direction opposite to the direction of circulation in said first chamber.

4. An apparatus for drying and conditioning tobacco leaves, comprising:

a chamber for drying tobacco leaves therein;

first and second conditioning chambers for conditioning tobacco leaves therein;

means for conveying tobacco leaves successively through said drying chamber and said first and second conditioning chambers, said conveying means being air permeable to permit the flow of drying or conditioning air therethrough;

means for drying tobacco leaves in said drying chamber;

means cooperating with each said conditioning chamber for circulating conditioning air through each said chamber respectively and through said conveying means for conditioning tobacco leaves in each said chamber;

means in the path of the conditioning air of each said chamber for heating the conditioning air of each said conditioning chamber;

a temperature detector in the path of the conditioning air in each said conditioning chamber for measuring the temperature of the conditioning air of each said conditioning chamber;

temperature controlling means cooperating with each said temeperature detector and each said heating means for controlling each said heating means so that the temperature of the conditioning air of each said conditioning chamber becomes a pre-set temperature;

means in the path of the conditioning air of each said conditioning chamber for spraying atomized water in the conditioning air for cooling the conditioning air;

means in the path of the conditioning air of each said conditioning chamber for injecting steam into the conditioning air of each said conditioning chamber for humidifying the conditioning air;

a humidity detector in the path of the conditioning air of each said conditioning chamber for measuring the humidity of the conditioning air of each said conditioning chamber;

means cooperating with each said humidity detector and each said steam injecting means for controlling each said steam injecting means so that the moisture content of tobacco leaves reaches a target moisture content; and, said first conditioning chamber air circulating means being adapted to circulate conditioning air through said first conditioning chamber and through said conveying means in a direction opposite to the direction of air circulation of said second conditioning chamber air circulating means.

* * * * *